US011575207B2

(12) United States Patent
Deleniv

(10) Patent No.: US 11,575,207 B2
(45) Date of Patent: Feb. 7, 2023

(54) PLUG-IN ANTENNA DEVICE WITH INTEGRATED FILTER

(71) Applicant: Telefonaktiebolaget LM Ericsson (publ), Stockholm (SE)

(72) Inventor: Anatoli Deleniv, Mölndal (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 51 days.

(21) Appl. No.: 16/963,434

(22) PCT Filed: Jan. 23, 2018

(86) PCT No.: PCT/SE2018/050048
§ 371 (c)(1),
(2) Date: Jul. 20, 2020

(87) PCT Pub. No.: WO2019/147172
PCT Pub. Date: Aug. 1, 2019

(65) Prior Publication Data

US 2021/0044024 A1 Feb. 11, 2021

(51) Int. Cl.
*H01Q 13/02* (2006.01)
*H01Q 21/06* (2006.01)

(52) U.S. Cl.
CPC ..... *H01Q 13/02* (2013.01); *H01Q 21/064* (2013.01)

(58) Field of Classification Search
CPC ..... H01Q 13/24; H01Q 1/46; H01Q 13/02; H01Q 9/0485; H01Q 19/08; H01Q 1/2291; H01Q 15/08; H01Q 21/205; H01Q 1/246; H01Q 1/36; H01Q 13/06; H01Q 15/24; H01Q 21/064; H01Q 13/10; H01Q 13/26;

(Continued)

(56) References Cited

U.S. PATENT DOCUMENTS 5,283,587 A 2/1994 Hirshfield et al.
5,517,203 A 5/1996 Fiedziuszko
(Continued)

FOREIGN PATENT DOCUMENTS

EP 1258946 A1 11/2002
EP 1296405 A2 3/2003
(Continued)

OTHER PUBLICATIONS

International Search Report and Written Opinion of the International Searching Authority dated Oct. 9, 2018 issued in PCT Application No. PCT/SE2018/050048, consisting of 8 pages.
EPO Communication and Supplementary Search Report dated Jun. 28, 2021 for Patent Application No. 18902538.0, consisting of 21-pages.

*Primary Examiner* — Hoang V Nguyen
(74) *Attorney, Agent, or Firm* — Christopher & Weisberg, P.A.

(57) ABSTRACT

The present disclosure relates to a plug-in antenna device arranged to be received in a waveguide section. The plug-in antenna device includes one or more dielectric elements arranged in series and spaced apart by connecting members, a top-most dielectric element being arranged as antenna element. When the plug-in antenna device is received in the waveguide section, the dielectric elements are arranged electromagnetically coupled, whereby a radio frequency signal included in a radio frequency band passing to or from the antenna element via the dielectric elements is arranged to be electromagnetically filtered.

19 Claims, 4 Drawing Sheets

(58) Field of Classification Search
CPC ..... H01Q 15/16; H01Q 21/00; H01Q 3/26; H01Q 3/30; H01Q 1/1242; H01Q 1/38; H01Q 13/106; H01Q 19/062; H01Q 19/193; H01Q 21/22; H01Q 21/29; H01Q 25/007; H01Q 3/18; H01Q 3/24; H01Q 3/245; H01Q 1/1228; H01Q 1/24; H01Q 1/42; H01Q 1/50; H01Q 13/025; H01Q 13/08; H01Q 13/20; H01Q 13/28; H01Q 19/13; H01Q 19/19; H01Q 21/067; H01Q 25/04; H01Q 3/02; H01Q 3/08; H01Q 3/22; H01Q 3/247; H01Q 5/10; H01Q 5/22; H01Q 5/55; H01Q 1/002; H01Q 1/02; H01Q 1/1207; H01Q 1/1221; H01Q 1/125; H01Q 1/22; H01Q 1/243; H01Q 1/34; H01Q 1/40; H01Q 1/422; H01Q 1/44; H01Q 1/48; H01Q 11/08; H01Q 11/083; H01Q 13/0241; H01Q 13/0275; H01Q 13/085; H01Q 13/103; H01Q 13/18; H01Q 13/22; H01Q 15/14; H01Q 15/242; H01Q 15/244; H01Q 19/108; H01Q 19/132; H01Q 19/136; H01Q 21/0037; H01Q 21/0087; H01Q 21/06; H01Q 21/061; H01Q 21/20; H01Q 21/24; H01Q 21/28; H01Q 25/002; H01Q 3/242; H01Q 3/2605; H01Q 5/47; H01Q 9/04; H01Q 9/0421; H01Q 9/42; H01P 1/2086
See application file for complete search history.

(56) References Cited

U.S. PATENT DOCUMENTS

| | | | | |
|---|---|---|---|---|
| 5,781,162 | A | 7/1998 | Peterson et al. | |
| 6,169,513 | B1 | 1/2001 | Cohen | |
| 7,379,030 | B1 * | 5/2008 | Lier | H01Q 19/08 343/822 |
| 10,854,984 | B2 * | 12/2020 | Kim | H01Q 21/24 |
| 2014/0057576 | A1 * | 2/2014 | Monte | H01Q 1/125 343/762 |
| 2017/0214110 | A1 * | 7/2017 | Shepard | H01Q 13/06 |

FOREIGN PATENT DOCUMENTS

| | | | | |
|---|---|---|---|---|
| EP | 1296405 | B1 * | 5/2008 | H01P 1/161 |
| EP | 2434575 | A1 | 3/2012 | |
| KR | 101788516 | B1 | 10/2017 | |

* cited by examiner

PLUG-IN ANTENNA DEVICE WITH INTEGRATED FILTER

CROSS-REFERENCE TO RELATED APPLICATION

This application is a Submission Under 35 U.S.C. § 371 for U.S. National Stage Patent Application of International Application Number: PCT/SE2018/050048, filed Jan. 23, 2018 entitled "A PLUG-IN ANTENNA DEVICE WITH INTEGRATED FILTER," the entirety of which is incorporated herein by reference.

TECHNICAL FIELD

The present disclosure relates to a plug-in antenna device for transmission and reception of radiofrequency signals, and also to antenna arrays, printed circuit boards, and methods related to the plug-in antenna device.

BACKGROUND

Antenna elements are devices configured to emit and/or to receive electromagnetic signals such as radio frequency (RF) signals used for wireless communication. Phased antenna arrays are antennas comprising a plurality of antenna elements, by which an antenna radiation pattern can be controlled by changing relative phases and amplitudes of signals fed to the different antenna elements.

Practical implementation of signal filtering functions for such antenna elements is a challenging task. High Q-factor, multiple resonators and high precision are required to achieve filters with low loss and strong suppression of frequencies near the operation band where interference or leakage of radio frequency (RF) power may occur. Microstrip and slot resonators are sometimes used to construct filters for antenna elements. However, low Q-factor of the microstrip or slot resonators cause an increased level of insertion loss. Also, traditional filters are typically designed as if they were isolated, which leads to a reduction of the antenna element bandwidth and a modification of the suppression characteristic due to interaction with the antenna.

Cost is important when designing antenna elements for use in antenna arrays. Since antenna arrays may comprise hundreds of antenna elements, individual antenna element cost significantly contributes to the total cost of producing the antenna array.

Integration and assembly aspects must also be considered. It is for example difficult to fit separate filters in the form of SMT-components (pick-and place and reflow soldering), since there is no place to put them with antennas on one side of a circuit board and active circuits on the other side.

Consequently, there is a need for improved filter arrangements for use with antenna elements.

SUMMARY

An object of the present disclosure is to provide improved filter arrangements for use with antenna elements.

This object is achieved by means of a plug-in antenna device arranged to be received in a waveguide section, the plug-in antenna device comprising one or more dielectric elements and a top-most dielectric element being arranged as antenna element. The dielectric elements are arranged in series and spaced apart by connecting members. When the plug-in antenna device is received in the waveguide section, the dielectric elements are arranged electromagnetically coupled, whereby a radio frequency signal comprised in a radio frequency band passing to or from the antenna element via the other dielectric elements is arranged to be electromagnetically filtered. 1.

This confers an advantage of providing a plug-in antenna device with an integrated filter, enabling a relatively low insertion loss. The filter and antenna is combined and co-designed, such that at least one of the resonances of the antenna is used as a resonator in the filter. The absence of irises leads to an uncomplicated filter structure.

According to some aspects, the plug-in antenna device is arranged to be received in a waveguide section having a dimension below a dimension associated with a cut-off frequency below a frequency of the radio frequency band.

According to some aspects, the waveguide section comprises an electrically conductive interior surface.

According to some aspects, a connecting member is a non-conductive element having exterior dimension smaller than an interior dimension of the waveguide section, thereby providing a gap between consecutive dielectric elements when received in the waveguide section.

This confers an advantage of enabling the plug-in antenna device to be produced as a single piece of plastic, enabling plastic molding.

According to some aspects, a connecting member is a further dielectric element having a permittivity value different from the permittivity values of the dielectric elements.

According to some aspects, a dielectric element is configured with a protrusion arranged to contact a corresponding surface of the waveguide section, thereby stopping the plug-in antenna device at a pre-determined position relative to the waveguide section when received in the waveguide section.

This confers an advantage of uncomplicated and reliable assembly.

According to some aspects, a bottom-most dielectric element of the dielectric elements arranged in series is configured with a depression arranged to contact a corresponding surface of the waveguide section, thereby stopping the plug-in antenna device at a pre-determined position relative to the waveguide section when received in the waveguide section.

This confers an advantage of uncomplicated and reliable assembly.

According to some aspects, the plug-in antenna device is arranged to transmit and/or to receive two different radio frequency signals via two different ports.

This confers an advantage of handling multiple frequencies.

According to some aspects, the plug-in antenna device is arranged integrally as one molded piece of plastic material.

This confers an advantage of low manufacturing cost due to well-established plastic molding production. This also enables extremely high repeatability and high tolerances since a molding tool can be iteratively improved to achieve a desired level of accuracy.

According to some aspects, the plug-in antenna device is configured with a cylindrical exterior shape, and arranged to be received in a waveguide section having circular interior cross-section.

This confers an advantage of uncomplicated and reliable assembly.

According to some aspects, the plug-in antenna device is comprising a conductive exterior surface configured with a first opening in the conductive exterior surface at the top-most dielectric element and a second opening in a bottom-most dielectric element of the dielectric elements arranged in series.

This confers an advantage of enabling the plug-in antenna device to be produced as a single piece of plastic, enabling plastic molding.

This object is also achieved by means of a manufacturing method for manufacturing a plug-in antenna device according to the above, comprising molding the plug-in antenna device as a plastic component.

This confers an advantage of low manufacturing cost due to well-established plastic molding production. This also enables extremely high repeatability and high tolerances since a molding tool can be iteratively improved to achieve a desired level of accuracy.

This object is also achieved by means of an array antenna arrangement that comprises a filtering block which in turn comprises a plurality of waveguide sections with respective plug-in antenna devices according to the above.

This confers an advantage of providing an easily assembled array antenna arrangement with the advantages of the plug-in antenna device according to the above.

According to some aspects, the filtering block is made of a conductive material.

According to some aspects, the filtering block is made of a non-conductive material.

This confers an advantage of enabling the filtering block to be produced as a single piece of plastic, enabling plastic molding.

According to some aspects, the interior waveguide section surfaces are metallized.

This object is also achieved by means of a printed circuit board (PCB), comprising an array antenna arrangement according to the above, and a plurality of feed circuits arranged to feed respective plug-in antenna devices of the array antenna arrangement.

This confers an advantage of providing a low-cost and reliable feeding structure.

This object is also achieved by means of a method of configuring a plug-in antenna device, comprising arranging one or more dielectric elements in series and spaced apart by connecting members, arranging a top-most dielectric element as antenna element, and configuring the plug-in antenna device to be received in a waveguide section. When the plug-in antenna device is received in the waveguide section, the dielectric elements are electromagnetically coupled, whereby a radio frequency signal comprised in a radio frequency band passing to or from the antenna element via the other dielectric elements is arranged to be electromagnetically filtered.

This confers an advantage of providing a plug-in antenna device with an integrated filter, enabling a relatively low insertion loss. The filter and antenna is combined and co-designed, such that at least one of the resonances of the antenna is used as a resonator in the filter. The absence of irises leads to an uncomplicated filter structure.

This object is also achieved by means of a manufacturing method for manufacturing an array antenna arrangement where the filtering block is made of a conductive material.

The method comprises heating the filtering block thereby expanding interior dimensions of the waveguide sections, and inserting a plug-in antenna device according to the above into a waveguide section. When the filtering block cools, the waveguide section is sealed around the inserted plug-in antenna device.

This confers an advantage of enabling a secure and reliable assembly.

BRIEF DESCRIPTION OF THE DRAWINGS

Further objects, features, and advantages of the present disclosure will appear from the following detailed description, wherein some aspects of the disclosure will be described in more detail with reference to the accompanying drawings, in which.

DETAILED DESCRIPTION

The inventive concept will now be described more fully hereinafter with reference to the accompanying drawings, in which certain embodiments of the inventive concept are shown. This inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description. Any step or feature illustrated by dashed lines should be regarded as optional.

Figures 1, 2, 3:
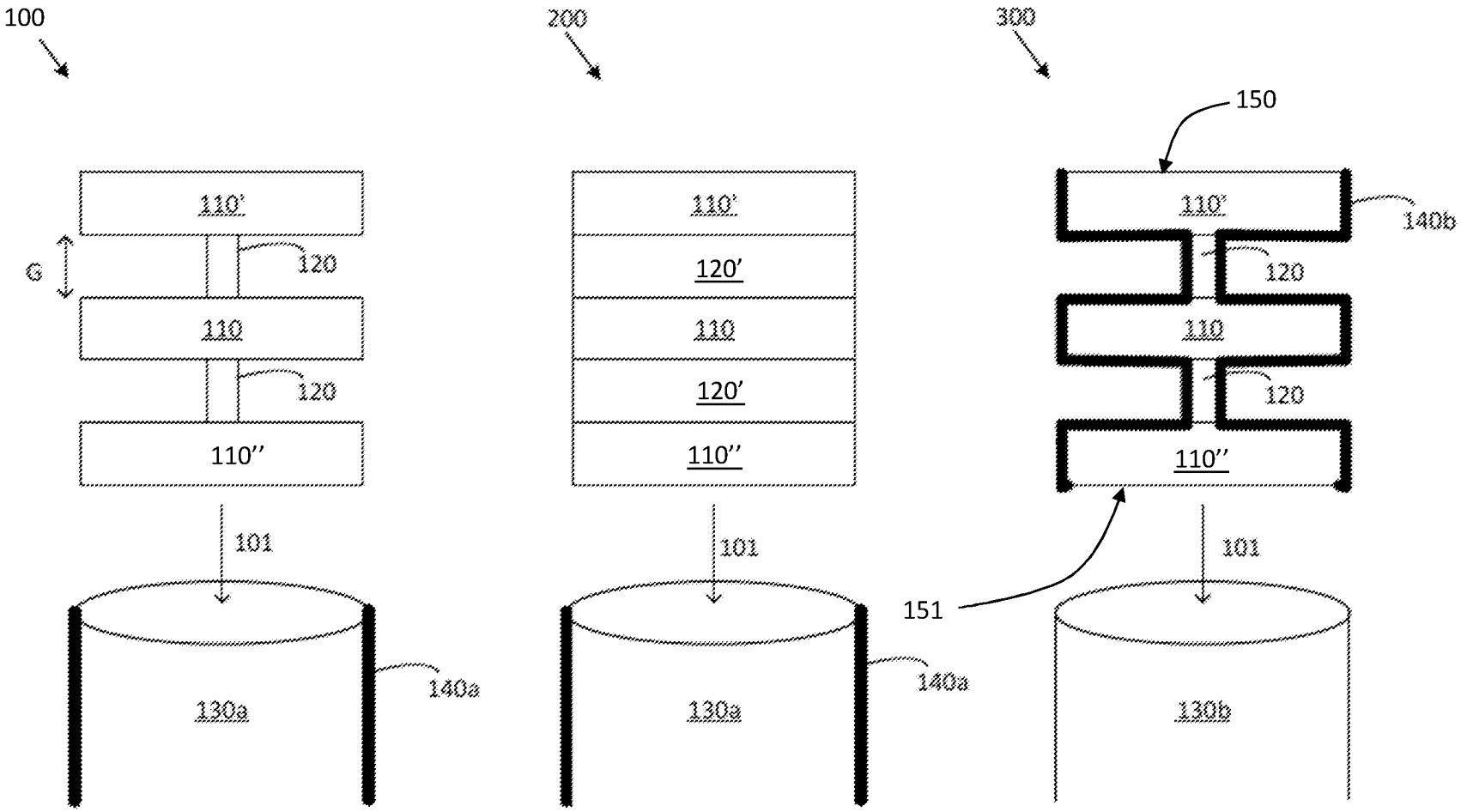
FIGS. 1-3 illustrate plug-in antenna devices according to embodiments.

With reference to FIG. 1 there is a waveguide section 130*a* with at least internally electrically conducting walls 140*a*, where the waveguide section 130*a* is arranged to conduct a radio frequency signal. According to the present disclosure, there is a plug-in antenna device 100 arranged to be received 101 in the waveguide section 130*a*, where the plug-in antenna device 100 comprises a lower-most dielectric element 110", an intermediate dielectric element 110 and a top-most dielectric element 110' arranged as an antenna element. The dielectric elements 110", 110, 110' are arranged in series and are spaced apart by connecting members 120 such that there is a spacing gap G between consecutive dielectric elements 110", 110, 110'.

When the plug-in antenna device 100 is received in the waveguide section 130*a*, the dielectric elements 110", 110, 110' are arranged electromagnetically coupled, whereby a radio frequency signal comprised in a radio frequency band passing to or from the antenna element via the dielectric elements 110", 110, 110' is arranged to be electromagnetically filtered. According to some aspects, the dielectric elements 110", 110, 110' have an exterior dimension that is equal to an interior dimension of the waveguide section 130*a*, such that the plug-in antenna device 100 is press-fitted in the waveguide section 130*a*. The plug-in antenna device 100 is according to some aspects configured with a cylindrical exterior shape, and arranged to be received in the waveguide section 130*a* having a corresponding circular interior cross-section.

The connecting members 120 are non-conductive elements which according to some aspects have exterior dimension smaller than an interior dimension of the waveguide section. By means of the connecting members 120, a proper spacing between the dielectric elements 110", 110, 110' is accomplished, here in the form of the spacing gap G.

According to some aspects, the plug-in antenna device 100 is made as a single piece component, arranged integrally as one molded piece of plastic material. Alternatively, the connecting members 120 have a permittivity value different from the permittivity values of the dielectric elements 110", 110, 110'.

The present disclosure is based on a waveguide section, for example a cylindrical waveguide section, which is partially loaded with a dielectric material.

Between the dielectric elements 110", 110, 110', the electromagnetic field is decaying, i.e. it is evanescent, where the coupling between two adjacent dielectric elements 110", 110, 110' is achieved by overlapping portions of their evanescent fields. In a typical filter, the coupling between resonators is realized by irises, i.e. openings in the common walls. By means of the present plug-in antenna device 100, the coupling between two adjacent dielectric elements 110", 110, 110' can be set to a desired level by choosing proper separation between them, removing the need for coupling irises.

According to some aspects, with reference to FIG. 2, the plug-in antenna device 200 comprises connecting members 120' that have the same exterior dimension as the dielectric elements 110", 110, 110'. In order to obtain a desired coupling between the dielectric elements 110", 110, 110', the connecting members 120' have a permittivity value different from the permittivity values of the dielectric elements 110", 110, 110'.

According to some aspects, with reference to FIG. 3, the waveguide section 130*b* is made in a non-conductive material, where the plug-in antenna device 300 comprises a conductive exterior surface 140*b* configured with a first opening 150 in the conductive surface at the top-most dielectric element 110' and a second opening 151 in the bottom-most dielectric element 110" of the dielectric elements arranged in series.

Figure 5A:
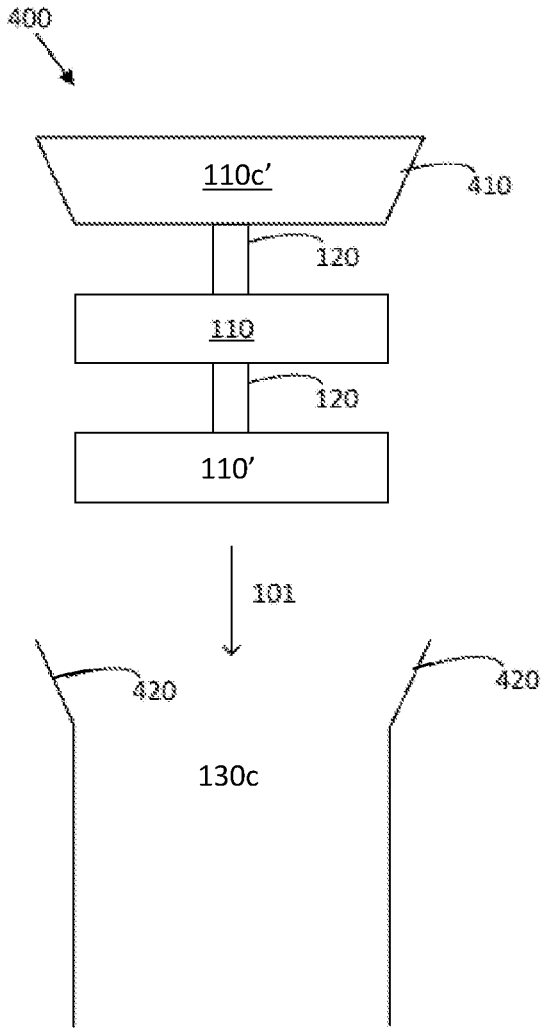
FIG. 5A illustrates a first example of a plug-in antenna device and a waveguide section.

According to some aspects, with reference to FIG. 5A, the plug-in antenna device 400 comprises a top-most dielectric element 110*c*' that is configured with a protrusion 410 arranged to contact a corresponding surface 420 of the waveguide section 130*c*, thereby stopping the plug-in antenna device at a pre-determined position relative to the waveguide section 130*c* when received in the waveguide section 130*c*.

Figure 5B:
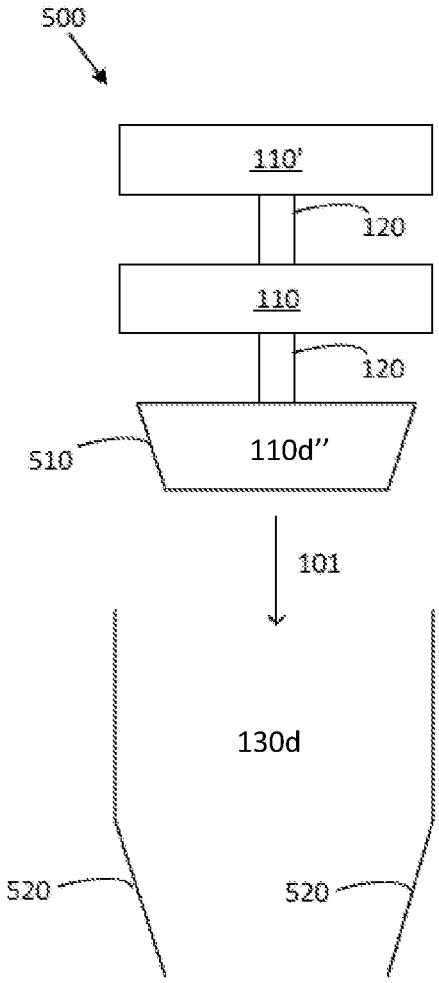
FIG. 5B illustrates a second example of a plug-in antenna device and a waveguide section.

According to some aspects, with reference to FIG. 5B, the plug-in antenna device 500 comprises a bottom-most dielectric element 110*d*" of the dielectric elements arranged in series is configured with a depression 510 arranged to contact a corresponding surface 520 of the waveguide section 130*d*, thereby stopping the plug-in antenna device 500 at a pre-determined position relative to the waveguide section 130*d* when received in the waveguide section 130*d*.

Figure 4A:
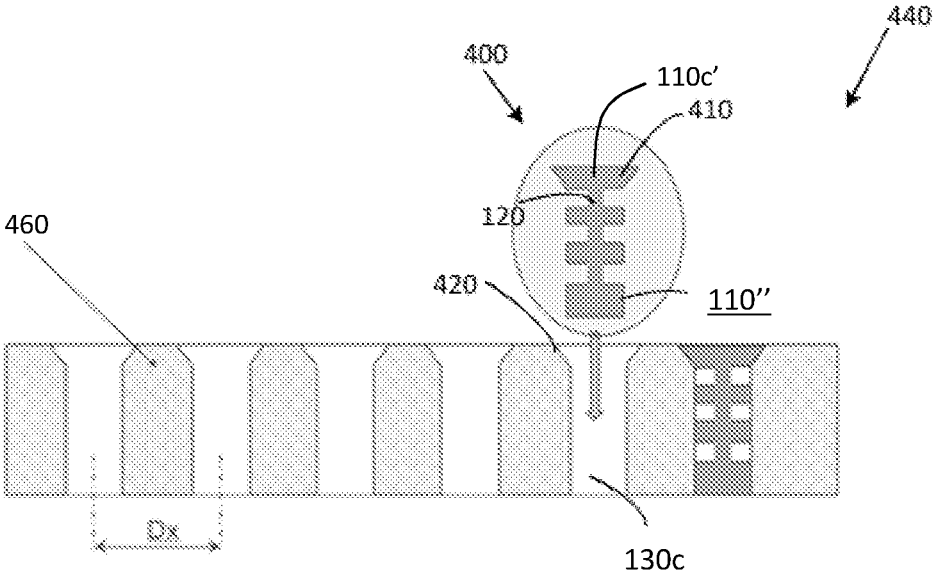
FIGS. 4A and 4B illustrate an example antenna array.

According to some aspects, with reference to FIG. 4*a*, there is a cut-open view of an array antenna arrangement 440 that comprising a filtering block 460 which in turn comprises a plurality of waveguide sections 130*c* of the same kind as shown in FIG. 5A with corresponding respective plug-in antenna devices 400. Here, the filtering block 460 is being loaded with precision-molded antenna devices 400.

Figure 4B:
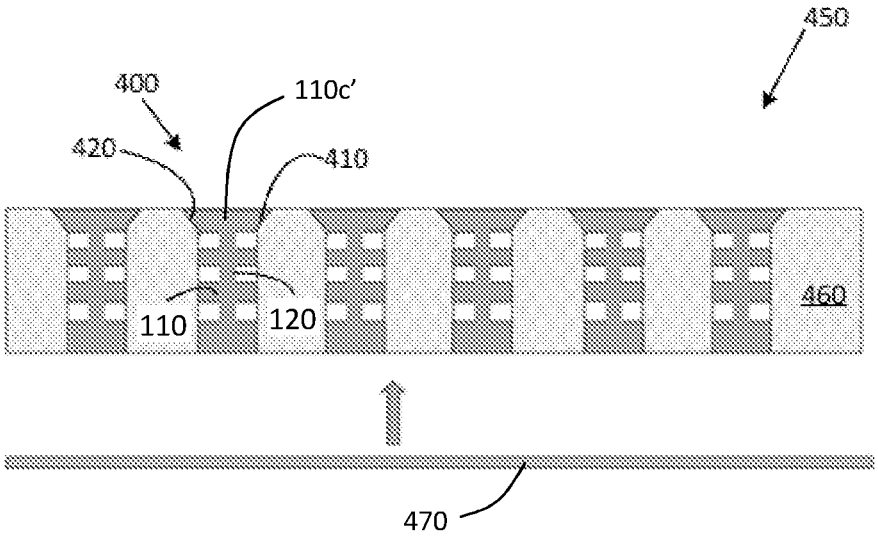

In FIG. 4*b*, the filtering block 460 has been loaded with the plug-in antenna devices 400, and a PCB board 470 carrying feed circuits for all plug-in antenna devices 400 is attached to the filtering block 460, for example by means of solder or glue.

According to some aspects, the filtering block 460 is a single piece of conductive material such as a metal block with predrilled holes in the case of cylindrical shape of the waveguide sections 130*c* and the plug-in antenna devices 400. Alternatively, a metallized plastic can be used as alternative material choice. Alternatively, a non-conductive material such as a plastic can be used as alternative material choice, in which case the plug-in antenna devices are metalized as described with reference to FIG. 3.

A cylindrical shape of the waveguide sections 130*c* and the plug-in antenna devices 400 enables a very uncomplicated fabrication and assembly of a phased array antenna arrangement 440 by loading the plug-in antenna devices 400 into the waveguide sections 130*c*.

Figure 6:
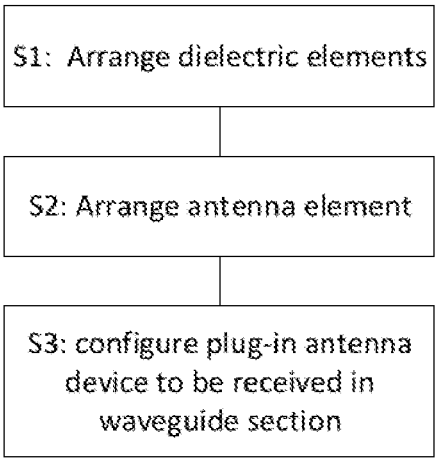
FIGS. 6-7 are flowcharts schematically illustrating methods according to embodiments.

With reference to FIG. 6, the present disclosure also relates to a method of configuring a plug-in antenna device 100, 200, 300, 400, 500. The method comprises:

Arranging S1 one or more dielectric elements 110", 110, 110' in series and spaced apart by connecting members 120.

Arranging S2 a top-most dielectric element 110'.

Configuring S3 the plug-in antenna device to be received in a waveguide section 130, 130*a*, 130*b*, 130*c*, 130*d*, wherein, when the plug-in antenna device 100, 200, 300, 400, 500 is received in the waveguide section 130, 130*a*, 130*b*, 130*c*, 130*d*, the dielectric elements 110", 110, 110' are electromagnetically coupled, whereby a radio frequency signal comprised in a radio frequency band passing to or from the antenna element 110' via the dielectric elements 110", 110, 110' is arranged to be electromagnetically filtered.

Figure 7:
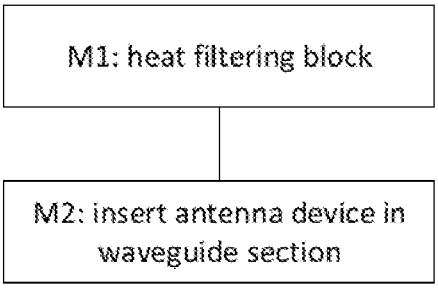

With reference to FIG. 4A, FIG. 4B and FIG. 7, the present disclosure also relates to a manufacturing method for manufacturing a plug-in antenna device 100, 200, 300, 400, 500. comprising molding the plug-in antenna device 100, 200, 300, 400, 500 as a plastic component.

With reference to FIG. 4A, FIG. 4B and FIG. 7, the present disclosure also relates to a manufacturing method for manufacturing an array antenna arrangement 450. The method comprises heating M1 the filtering block 460, thereby expanding interior dimensions of the waveguide sections 130*c*, and inserting M2 a plug-in antenna device 400 into a waveguide section 130*c*, whereby, when the filtering block 460 cools, the waveguide section 130*c* is sealed around the inserted plug-in antenna device 400.

The present disclosure confers reliability and relatively low insertion loss.

The plug-in antenna device 100, 200, 300, 400, 500 is based on a relatively uncomplicated structure that according to some aspects constitutes plastic as only ingredient. This confers production reliability since potential issues due to lamination, metallization, drilling of via holes, etc. are avoided.

The Q-factors are improved, where there are two factors contributing to this improvement.

A partially filled resonator comprising a plug-in antenna device 100, 200, 300, 400, 500 can be molded in plastic that has a much better dielectric loss than typical PCB laminates.

The Q-factor of a typical partially filled cavity such as the waveguide section 130*a*, 130*b*, 130*c*, 130*d* with a fitted plug-in antenna device 100, 200, 300, 400, 500 can be computed using the following equation:

$$\frac{1}{Q} = k\tan\delta + \frac{1}{Qm}$$

Here, Q denotes the Q-factor, tan δ is a dielectric loss tangent, k is a so-called inclusion rate of dielectric that indicates the part of electric field energy that is circulating in a dielectric part, $0<k<1$, while 1/Qm represents conductor losses in the resonator. For an appropriate class of dielectric materials, the conductor loss can be neglected as its contribution is considerably lower. It is than evident from the formula above that depending on design of the resonator, i.e. choice of inclusion rate k, it is possible to reach Q factors better than for any PCB-based resonator using similar dielectrics. The latter has k=1, unless some of the material is removed. Also in PCB cavities, the contribution of metal loss is considerably higher in comparison to cut-off circular waveguide due quality of metallization and due to contribution of metallized via holes.

The present disclosure is not limited to the above examples, but may vary freely within the scope of the appended claims. For example, at least one waveguide section has a dimension below a dimension associated with a cut-off frequency below a frequency of the radio frequency band.

According to some aspects, the plug-in antenna device 100, 200, 300, 400, 500 is arranged to transmit and/or to receive two different radio frequency signals via two different ports.

According to some aspects, there may be any number of consecutively arranged dielectric elements, but there is at least a lower-most dielectric elements 110" and a top-most dielectric element being arranged as antenna element 110'. The lower-most dielectric elements 110" and the top-most dielectric element 110' are arranged at opposite ends along a longitudinal extension of the plug-in antenna device.

Generally, the present disclosure relates to a plug-in antenna device 100, 200, 300, 400, 500 arranged to be received 101 in a waveguide section 130*a*, 130*b*, 130*c*, 130*d*, the plug-in antenna device 100, 200, 300, 400, 500 comprising one or more dielectric elements 110, 110" and a top-most dielectric element being arranged as antenna element 110', where the dielectric elements 110", 110, 110' are arranged in series and spaced apart by connecting members 120, 120', wherein, when the plug-in antenna device 100, 200, 300, 400, 500 is received in the waveguide section 130*a*, 130*b*, 130*c*, 130*d*, the dielectric elements 110, 110' are arranged electromagnetically coupled, whereby a radio frequency signal comprised in a radio frequency band passing to or from the antenna element 110' via the other dielectric elements 110", 100 is arranged to be electromagnetically filtered.

According to some aspects, the plug-in antenna device is arranged to be received in a waveguide section 130*a*, 130*b*, 130*c*, 130*d* having a dimension below a dimension associated with a cut-off frequency below a frequency of the radio frequency band.

According to some aspects, the waveguide section 130*a* comprises an electrically conductive interior surface 140*a*.

According to some aspects, a connecting member 120 is a non-conductive element having exterior dimension smaller than an interior dimension of the waveguide section, thereby providing a gap G between consecutive dielectric elements 110", 110, 110' when received in the waveguide section.

According to some aspects, a connecting member 120, 120' is a further dielectric element having a permittivity value different from the permittivity values of the dielectric elements 110.

According to some aspects, a dielectric element 110*c*' is configured with a protrusion 410 arranged to contact a corresponding surface 420 of the waveguide section 130*c*, thereby stopping the plug-in antenna device 400 at a predetermined position relative to the waveguide section 130*c* when received in the waveguide section.

According to some aspects, a bottom-most dielectric element 110*d*" of the dielectric elements arranged in series is configured with a depression 510 arranged to contact a corresponding surface 520 of the waveguide section 130*d*, thereby stopping the plug-in antenna device 500 at a predetermined position relative to the waveguide section 130*d* when received in the waveguide section 130*d*.

According to some aspects, the plug-in antenna device is arranged to transmit and/or to receive two different radio frequency signals via two different ports.

According to some aspects, the plug-in antenna device is arranged integrally as one molded piece of plastic material.

According to some aspects, the plug-in antenna device is configured with a cylindrical exterior shape, and arranged to be received in a waveguide section having circular interior cross-section.

According to some aspects, the plug-in antenna device comprises a conductive exterior surface 140*b* configured with a first opening 150 in the conductive exterior surface at the top-most dielectric element 110' and a second opening 151 in a bottom-most dielectric element 110" of the dielectric elements arranged in series.

Generally, the present disclosure also relates to an array antenna arrangement 440, 450, comprising a filtering block 460, the filtering block comprising a plurality of waveguide sections with respective plug-in antenna devices 100, 200, 300, 400, 500 according to the above.

According to some aspects, the filtering block 460 is made of a conductive material.

According to some aspects, the filtering block 460 is made of a non-conductive material.

According to some aspects, the interior waveguide section surfaces are metallized.

Generally, the present disclosure relates to a printed circuit board 470, PCB, comprising an array antenna arrangement 450 according to the above, and a plurality of feed circuits arranged to feed respective plug-in antenna devices of the array antenna arrangement.

Generally, the present disclosure relates to a method of configuring a plug-in antenna device 100, 200, 300, 400, 500, comprising arranging S1 one or more dielectric elements 110", 110, 100' in series and spaced apart by connecting members 120, 120', arranging S2 a top-most dielectric element as antenna element 110', configuring S3 the plug-in antenna device 100, 200, 300, 400, 500 to be received in a waveguide section 130*a*, 130*b*, 130*c*, 130*d*, wherein, when the plug-in antenna device 100, 200, 300, 400, 500 is received in the waveguide section 130*a*, 130*b*, 130*c*, 130*d*, the dielectric elements 110", 110, 100' are electromagnetically coupled, whereby a radio frequency signal comprised in a radio frequency band passing to or from the antenna element 110' via the other dielectric elements 110", 110' is arranged to be electromagnetically filtered.

Generally, the present disclosure relates to a manufacturing method for manufacturing a plug-in antenna device 100, 200, 300, 400, 500 according to the above, comprising molding the plug-in antenna device 100, 200, 300, 400, 500 as a plastic component.

Generally, the present disclosure relates to a manufacturing method for manufacturing an array antenna arrangement 450 where the filtering block 460 is made of a conductive material, the method comprising heating M1 the filtering block 460, thereby expanding interior dimensions of the waveguide sections 130*c*, and inserting M2 a plug-in antenna device 400 according to the above into a waveguide section 130*c*, whereby, when the filtering block 460 cools, the waveguide section 130*c* is sealed around the inserted plug-in antenna device 400.

The invention claimed is:

1. A plug-in antenna device configured to be received in a waveguide section, the plug-in antenna device comprising:

a plurality of dielectric elements including a top-most dielectric element being arranged configured as an antenna element, the dielectric elements being arranged in series and spaced apart by connecting members;

a conductive exterior surface configured with a first opening in the conductive exterior surface at the top-most dielectric element and a second opening in the conductive exterior surface in a bottom-most dielectric element of the dielectric elements arranged in series, all of the plurality of dielectric elements having an exterior dimension that is equal to an interior dimension of the waveguide section; and when the plug-in antenna device is received in the waveguide section, the dielectric elements are electromagnetically coupled, a radio frequency signal comprised in a radio frequency band passing to or from the antenna element via the other dielectric elements is electromagnetically filtered.

2. The plug-in antenna device according to claim 1, configured to be received in a waveguide section, the waveguide section having a dimension below a dimension associated with a cut-off frequency below a frequency of the radio frequency band.

3. The plug-in antenna device according to claim 2, wherein the waveguide section comprises an electrically conductive interior surface.

4. The plug-in antenna device according to claim 2, wherein a connecting member is a non-conductive element having exterior dimension smaller than an interior dimension of the waveguide section, thereby providing a gap between consecutive dielectric elements when received in the waveguide section.

5. The plug-in antenna device according to claim 2, wherein the waveguide section comprises an electrically conductive interior surface.

6. The plug-in antenna device according to claim 2, wherein a connecting member is a non-conductive element having exterior dimension smaller than an interior dimension of the waveguide section, thereby providing a gap between consecutive dielectric elements when received in the waveguide section.

7. The plug-in antenna device according to claim 2, wherein a connecting member is a further dielectric element having a permittivity value different from the permittivity values of the dielectric elements.

8. The plug-in antenna device according to claim 2, wherein the top-most dielectric element is configured with a protrusion arranged to contact a corresponding surface of the waveguide section, thereby stopping the plug-in antenna device at a pre-determined position relative to the waveguide section when received in the waveguide section.

9. The plug-in antenna device according to claim 2, wherein a bottom-most dielectric element of the dielectric elements arranged in series is configured with a depression arranged to contact a corresponding surface of the waveguide section, thereby stopping the plug-in antenna device at a pre-determined position relative to the waveguide section when received in the waveguide section.

10. The plug-in antenna device according to claim 2, configured to at least one of transmit and receive two different radio frequency signals via two different ports.

11. The plug-in antenna device according to claim 2, integrally formed as one molded piece of plastic material.

12. The plug-in antenna device according to claim 1, wherein a connecting member is a further dielectric element having a permittivity value different from the permittivity values of the dielectric elements.

13. The plug-in antenna device according to claim 1, wherein the top-most dielectric element is configured with a protrusion arranged to contact a corresponding surface of the waveguide section, thereby stopping the plug-in antenna device at a pre-determined position relative to the waveguide section when received in the waveguide section.

14. The plug-in antenna device according to claim 1, wherein a bottom-most dielectric element of the dielectric elements arranged in series is configured with a depression arranged to contact a corresponding surface of the waveguide section, thereby stopping the plug-in antenna device at a pre-determined position relative to the waveguide section when received in the waveguide section.

15. The plug-in antenna device according to claim 1, configured to at least one of transmit and receive two different radio frequency signals via two different ports.

16. The plug-in antenna device according to claim 1, integrally formed as one molded piece of plastic material.

17. The plug-in antenna device according to claim 1, configured with a cylindrical exterior shape, and arranged to be received in a waveguide section having circular interior cross-section.

18. An array antenna arrangement, comprising:

a filtering block, the filtering block comprising:

a plurality of waveguide sections with respective plug-in antenna devices, each respective plug-in antenna device configured to be received in a waveguide section, each plug-in antenna device comprising:

at least one dielectric element and a top-most dielectric element being arranged configured as an antenna element, the dielectric elements being arranged in series and spaced apart by connecting members, all of the dielectric elements having an exterior dimension that is equal to an interior dimension of the waveguide section;

a conductive exterior surface configured with a first opening in the conductive exterior surface at the top-most dielectric element and a second opening in the conductive exterior surface in a bottom-most dielectric element of the dielectric elements arranged in series; and when the plug-in antenna device is received in the waveguide section, the dielectric elements are electromagnetically coupled, a radio frequency signal comprised in a radio frequency band passing to or from the antenna element via the other dielectric elements is electromagnetically filtered.

19. A method of configuring a plug-in antenna device, the method comprising:

arranging a plurality of dielectric elements in series and spaced apart by connecting members;

arranging a top-most dielectric element of the plurality of dielectric elements as an antenna element;

arranging a conductive exterior surface configured with a first opening in the conductive exterior surface at the top-most dielectric element and a second opening in the conductive exterior surface in a bottom-most dielectric element of the dielectric elements arranged in series, all of the plurality of dielectric elements having an exterior dimension that is equal to an interior dimension of the waveguide section;

configuring the plug-in antenna device to be received in a waveguide section; and when the plug-in antenna device is received in the waveguide section, the dielectric elements are electromagnetically coupled, a radio frequency signal comprised in a radio frequency band passing to or from the antenna element via the other dielectric elements is electromagnetically filtered.

* * * * *